US007819108B2

(12) United States Patent
Froehlich et al.

(10) Patent No.: US 7,819,108 B2
(45) Date of Patent: Oct. 26, 2010

(54) DELIVERY UNIT

(75) Inventors: Walter Froehlich, Frankfurt am Main (DE); Günter Rauchhaus, Raunheim (DE); Thomas Sippel, Fulda (DE)

(73) Assignee: Continental Automotive GmbH, Hannover (DE)

( * ) Notice: Subject to any disclaimer, the term of this patent is extended or adjusted under 35 U.S.C. 154(b) by 49 days.

(21) Appl. No.: 12/300,443

(22) PCT Filed: Jan. 30, 2008

(86) PCT No.: PCT/EP2008/051149

§ 371 (c)(1),
(2), (4) Date: Nov. 11, 2008

(87) PCT Pub. No.: WO2008/098840

PCT Pub. Date: Aug. 21, 2008

(65) Prior Publication Data

US 2009/0165753 A1 Jul. 2, 2009

(30) Foreign Application Priority Data

Feb. 13, 2007 (DE) ..... 10 2007 007 597
Jan. 21, 2008 (DE) ..... 10 2008 005 358

(51) Int. Cl.
*F02M 37/04* (2006.01)

(52) U.S. Cl. ..... 123/509

(58) Field of Classification Search ..... 123/509
See application file for complete search history.

(56) References Cited

U.S. PATENT DOCUMENTS 5,482,444 A * 1/1996 Coha et al. ..... 417/363
6,047,685 A * 4/2000 Schelhas et al. ..... 123/510
6,216,671 B1 * 4/2001 Sawert et al. ..... 123/509
6,360,765 B1 * 3/2002 Pozgainer ..... 137/15.01
6,382,190 B1 * 5/2002 Tanabe et al. ..... 123/509
6,530,757 B1 * 3/2003 Soyer et al. ..... 417/423.14
6,840,230 B2 * 1/2005 Ichikawa et al. ..... 123/509
6,840,231 B2 * 1/2005 Suzuki ..... 123/509
6,890,190 B1 * 5/2005 Jurcak et al. ..... 439/92
7,074,058 B2 * 7/2006 Jurcak et al. ..... 439/92
7,185,682 B2 * 3/2007 Riegel et al. ..... 141/97
7,341,046 B2 * 3/2008 Leymarie et al. ..... 123/509
7,398,769 B2 * 7/2008 Athalye ..... 123/509
7,472,693 B2 * 1/2009 Izutani et al. ..... 123/509
7,527,042 B2 * 5/2009 Crary ..... 123/509
2004/0112819 A1 6/2004 Ebihara
2006/0272619 A1 12/2006 Yamashita et al.

FOREIGN PATENT DOCUMENTS

JP 09268957 10/1997
JP 2003172218 6/2003
JP 2003286925 10/2003
JP 2004275839 10/2004

* cited by examiner

*Primary Examiner*—Thomas N Moulis
(74) *Attorney, Agent, or Firm*—Cohen Pontani Lieberman & Pavane LLP

(57) ABSTRACT

The invention relates to a delivery unit for delivering fuel from a fuel reservoir (2) to an internal combustion engine of a motor vehicle. Said delivery unit comprises a fuel pump which is arranged in a swirl pot (4), and a flange (3) which closes an opening (5) of the fuel reservoir, the swirl pot being connected to the flange via at least two supporting elements (6). The supporting elements consist of a fuel-resistant plastic material.

16 Claims, 3 Drawing Sheets

DELIVERY UNIT

PRIORITY CLAIM

This is a U.S. national stage of application Ser. No. PCT/EP2008/098840, filed Jan. 30, 2008, priority is claimed on German Application Nos. 10 2007 007 597.0, filed Feb. 13, 2008, and 10 2008 005 358.9 filed Jan. 21, 2008, the contents of all of which are incorporated herein by reference.

BACKGROUND OF THE INVENTION

1. Field of the Invention

The subject matter of the invention is a delivery unit for delivering fuel from a fuel tank to an internal combustion engine of a motor vehicle. Specifically, a fuel pump is arranged in a swirl pot that has a flange which closes an opening of the fuel tank, wherein the swirl pot is connected to the flange via at least two supporting elements.

2. Description of the Prior Art

Delivery units of this type have long been known and are therefore prior art. It is known in this respect to design the supporting elements as metal tubes. The supporting elements are pressed into receiving bushings in the flange by means of an interference fit. The circumference of the swirl pot or splash pot has corresponding guides in which the supporting elements are guided in a longitudinally displaceable manner. Spiral springs which surround the supporting elements and are supported at one end on the respective supporting element or on the flange and at the other end on the swirl pot cause the swirl pot to be prestressed toward the bottom of the fuel tank. Owing to specified safety regulations, metal parts having a capacitance of greater than 3 pF have to be protected against static charges. This means that the metal tubes have to be grounded, thus increasing the outlay or cost of the delivery unit.

SUMMARY OF THE INVENTION

The present invention is therefore based providing a delivery unit at a low cost.

The object is achieved in that the supporting elements consist of a fuel-resistant plastic material.

The selection of a fuel-resistant plastic material as the material for the supporting elements means that the latter have a capacitance of less than 3 pF. In accordance with the specified safety regulations, said components therefore do not additionally have to be protected against static charges. Grounding of the supporting elements can therefore be omitted, thus reducing the cost of the delivery unit.

Polyoxymethylene or polyamide have proven worthwhile as plastic materials for use in fuel-containing environments and are furthermore distinguished by being easily processed, in particular by means of injection molding.

To further increase the protection against electrostatic charges, or the safe dissipation thereof, it is advantageous if the plastic material for the supporting elements contains admixtures of carbon in the form of soot or nanotubes.

If the swirl pot and in particular the guides for the supporting elements likewise consist of plastic, an undesirable production of noise may occur during movement of the supporting elements in the guides. Such a production of noise is avoided if the plastic material for the supporting elements contains admixtures of chalk.

In order to obtain adequate stability for the supporting elements with small cross-sectional dimensions, it has proven advantageous to provide the supporting elements with a profiling running along their longitudinal axis.

Very varied shapes are conceivable as the profiles. However, solid profiles have proven worthwhile in addition to hollow profiles. According to an advantageous refinement, a low use of material with adequate strength is achieved with supporting elements which have a profiling designed as webs.

The fastening of the supporting elements proves particularly simple if the supporting elements, at their end facing the swirl pot, have at least one radially outwardly directed latching hook. When the supporting elements are first introduced into the guides of the swirl pot, the at least one latching hook is reversibly deformed until it has passed the guide. It subsequently moves into its initial position, as a result of which the respective supporting element is secured against release from the guide. The supporting elements can thereby be fitted in a particularly simple manner.

BRIEF DESCRIPTION OF THE DRAWINGS

The invention is explained in more detail using an exemplary embodiment. In the figures

DETAILED DESCRIPTION OF THE PRESENTLY PREFERRED EMBODIMENTS

Figure 1:
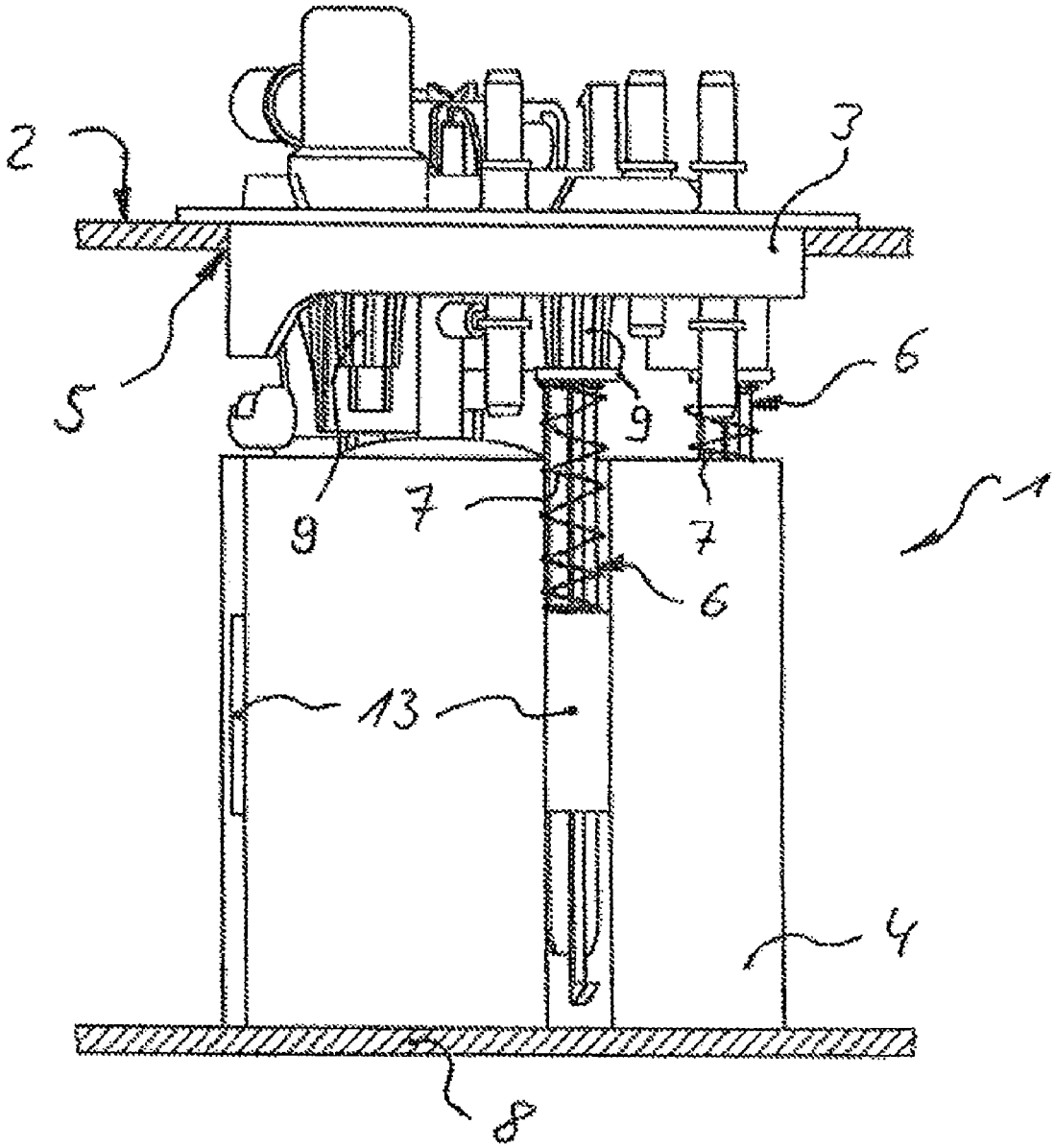
FIG. 1 shows a delivery unit according to the invention.

FIG. 1 shows a delivery unit 1 for use in a fuel tank 2 of a motor vehicle. The delivery unit 1 comprises a flange 3 and a swirl pot 4. The flange 3 is designed in such a manner that it closes an opening 5 of the fuel tank 2, through which opening the delivery unit 1 is inserted in the fuel tank 2. A fuel pump (not illustrated) is arranged in the swirl pot 4, said fuel pump delivering fuel from the swirl pot 4 through the flange 3 to an internal combustion engine (not illustrated) of the motor vehicle. Guides 13 in which a respective supporting element 6 engages are arranged on the circumference of the swirl pot 4. Each supporting element 6 is surrounded by a helical spring 7. The helical springs 7 are supported on the flange 3 and on the guides 13 and thereby bring about a prestressing of the swirl pot 4 toward the bottom 8 of the fuel tank 2.

Figure 2:
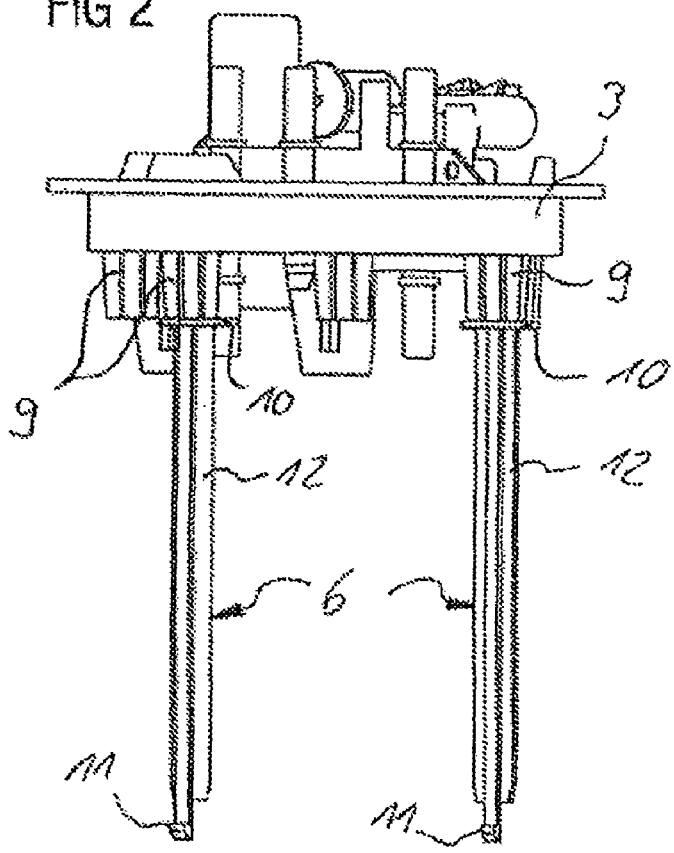
FIGS. 2, 3 show the flange of the delivery unit according to FIG. 1.
Figure 3:
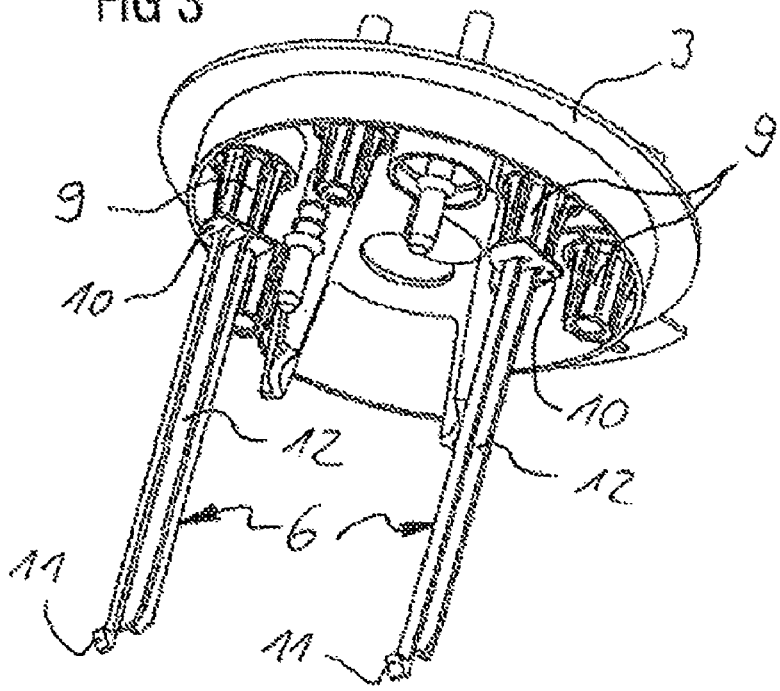

FIGS. 2 and 3 show the flange 3 with the supporting elements 6. For the fastening of the supporting elements 6, the flange has bushings 9 into which the supporting elements 6 are pressed. In the upper region, the supporting elements 6 each have a collar 10 which delimits the insertion depth of the supporting elements 6. At the same time, it is thereby ensured that each supporting element 6 is pressed in to the same depth and therefore the swirl pot is prestressed by the helical springs 7 toward all of the latching hooks 11 at the lower end of the supporting elements 6 before the delivery unit 1 is fitted in the fuel tank 2. The supporting elements 6 consist of polyamide. To avoid electrostatic charges, carbon in the form of soot is admixed. For mechanical reinforcement, the supporting elements 6 have webs 12 running axially. Furthermore, the webs 12 form a good guide for the helical springs.

Figure 4A:
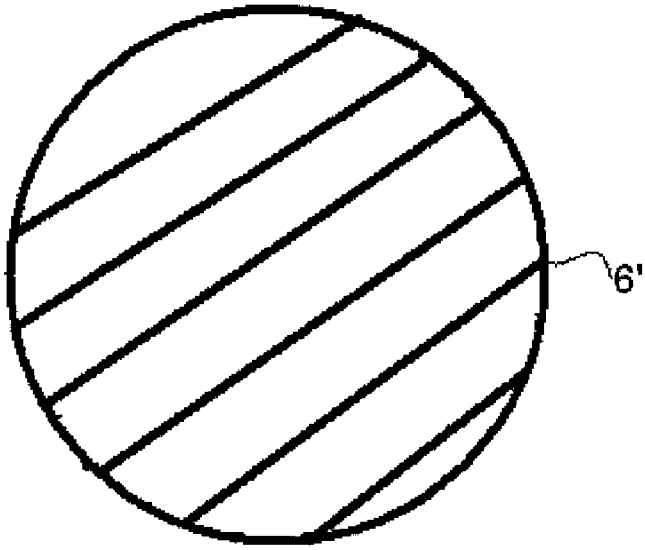
FIGS. 4*a* and 4*b* are cross sections of the supporting elements.
Figure 4B:
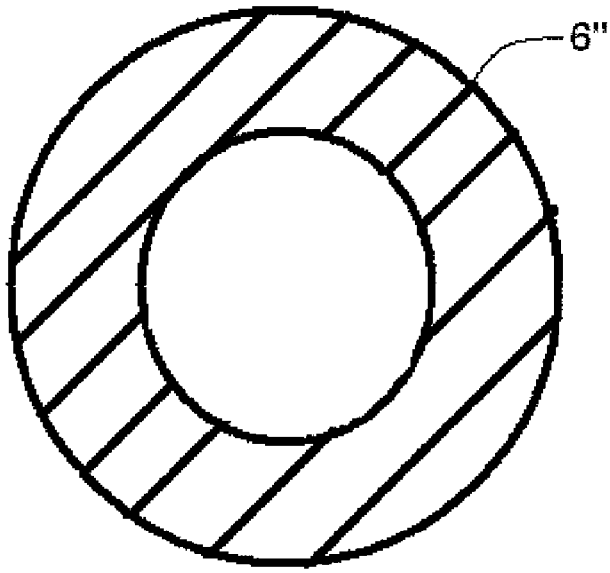

FIG. 4*a* is a cross section of a support element 6. As shown in FIG. 4*a*, the support element 6' is a solid rod. FIG. 4*b* is another cross section of the support element 6". As shown in FIG. 4*b*, the support element 6" is a hollow rod.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A fuel delivery unit for delivering fuel from a fuel tank to an internal combustion engine, the fuel delivery unit comprising:

a swirl pot having at least two support guides;

a fuel pump which is arranged in the swirl pot;

a flange adapted to an opening of the fuel tank, the flange comprising at least two bushings; and at least two fuel-resistant chalk-filled plastic supporting elements, the support elements each having a first end adapted to mount in one of the bushings, the at least two supporting elements further configured to mate with the support guides, wherein the swirl pot is attached to the flange via the supporting elements.

2. The fuel delivery unit according to claim 1, wherein the at least two supporting elements are at least one of polyoxymethylene and polyamide.

3. The fuel delivery unit according to claims 1, wherein the at least two supporting elements contain admixtures of carbon.

4. The fuel delivery unit according to claim 1, wherein each of the at least two supporting elements have a profile on its longitudinal axis.

5. The fuel delivery unit according to claim 4, wherein the at least two supporting elements have a profile configured as a web.

6. The fuel delivery unit according to claim 1, wherein each of the at least two supporting elements further comprises at least one latching hook facing the swirl pot at a second end of the supporting elements.

7. The fuel delivery unit according to claim 2, wherein each of the at least two supporting elements contain admixtures of carbon.

8. The fuel delivery unit according to claim 3, wherein the carbon is at least one of soot or nanotubes.

9. The fuel delivery unit according to claim 7, wherein the carbon is at least one of soot or nanotubes.

10. The fuel delivery unit according to claim 6, wherein the at least one latching hook is directed radially outwardly.

11. A fuel delivery unit for delivering fuel from a fuel tank to an internal combustion engine, the fuel delivery unit comprising:

a swirl pot having at least two support guides;

a fuel pump which is arranged in the swirl pot;

a flange adapted to an opening of the fuel tank, the flange comprising at least two bushings; and at least two fuel-resistant plastic supporting elements, the support elements each having a first end adapted to mount in one of the bushings, the at least two supporting elements further configured to mate with the support guides, wherein the swirl pot is attached to the flange via the supporting elements, and the at least two supporting elements have a capacitance of less than 3 pF.

12. The fuel delivery unit according to claim 1, further comprising a helical spring surrounding each of the at least two supporting elements.

13. The fuel delivery unit according to claim 12, wherein each of the at least two supporting elements further comprises a collar at the first end of the supporting element, the collar defining an insertion depth of the supporting element into the bushing and supporting one end of the helical spring.

14. The fuel delivery unit according to claim 13, wherein the helical spring is supported between the support guide and collar.

15. The fuel delivery unit according to claim 4, wherein at least one of the two supporting elements has a profile configured as at least one of a solid rod and a hollow tube.

16. The fuel delivery unit according to claim 14, wherein the helical spring presses the swirl pot towards a bottom of the fuel tank.

* * * * *